United States Patent [19]

Shelley et al.

[11] 3,937,365

[45] Feb. 10, 1976

[54] AUGER LIFT MECHANISM FOR AUTOMATIC ICE DISPENSERS

[75] Inventors: George R. Shelley; Robert J. Shelley, Jr., both of Miami; Arthur B. Dixon, Coral Gables; Bruce F. House, North Miami Beach, all of Fla.

[73] Assignee: Shelley Manufacturing Company, Miami, Fla.

[22] Filed: July 17, 1974

[21] Appl. No.: 489,385

[52] U.S. Cl. ..... 222/241

[51] Int. Cl.[2] ..... G01F 11/00

[58] Field of Search..... 221/150; 222/146 C, 240, 222/239, 413, 241; 198/213

[56] References Cited

UNITED STATES PATENTS

| | | | |
|---|---|---|---|
| 2,895,720 | 7/1959 | Koch et al. | 198/213 X |
| 3,211,338 | 10/1965 | Weil et al. | 222/146 C |
| 3,608,786 | 9/1971 | Shelley et al. | 222/413 |

*Primary Examiner*—Stanley H. Tollberg
*Attorney, Agent, or Firm*—Ernest H. Schmidt

[57] ABSTRACT

An improved elevating mechanism for combinative use with a vertically rotating auger for elevating crushed or cube ice in automatic ice dispensing equipment, comprising a bent-metal abutment slide member partially surrounding the auger and operative to constrain ice being elevated thereby to movement in the upward direction to a dispensing chute, and having an outwardly-extending wing portion serving as a guide at an open side of the slide member for moving ice being directed into the mouth by a rotating ice feeder disc at the lower end of the auger into lower end portions thereof for continuous supply thereto as ice is being displaced toward the upper end of the auger.

6 Claims, 6 Drawing Figures

AUGER LIFT MECHANISM FOR AUTOMATIC ICE DISPENSERS

In applicants' U.S. Pat. No. 3,715,119, issued Feb. 6, 1973 there is described an automatic ice dispenser for dispensing crushed ice or ice cubes wherein an ice elevating mechanism in the form of an auger having a bottom ice feeder disc and an auger tube within which the auger turns for elevating the ice to a dispensing spout is described. The present invention relates to improvements in such ice elevating mechanism.

The principal object of this invention is to provide, in an automatic ice dispenser of the character described, a simplified elevating mechanism cooperative with an auger serving as a replacement for the auger tube heretofore used, while at the same time effecting improved elevating of ice, particularly cube ice, from the associated ice bin to a discharge spout.

Another object of the invention is to provide a novel and improved elevating mechanism for cooperative use with an auger in an ice dispenser, which elevating mechanism, instead of completely surrounding the auger, is open at one side to minimize any possibility of jamming in an auger tube, as occurred occassionally in prior auger tube lifting mechanisms.

Yet another object of the invention is to provide an auger ice lifting mechanism of the character described which, at the open side of the elevating mechanism, comprises an outwardly-extending wing or wall portion the lower edge of which terminates in close proximity to the rotary feeder disc at the lower end of the auger, thereby serving as an efficient guide means for directing crushed or cube ice being churned by the rotary disc toward the auger.

Yet another object of the invention is to provide an elevating mechanism of the above nature wherein the auger and its associated ice feeder disc is driven at its upper end by an electric drive motor from which it can readily be disconnected for removal and cleaning, and wherein the associated relatively-fixed elevating mechanism can similarly be separately removed for cleaning.

Still another object is to provide an auger actuated elevating mechanism for automatic ice dispensers which will be simple in construction, economical in cost, easy to remove and replace with respect to its ice bin or cabinet, and which will be dependable, efficient and durable in operation.

Other objects, features and advantages of the invention will be apparent from the following description when read with reference to the accompanying drawings. In the drawings, wherein like reference numerals denote corresponding parts throughout the several views.

Figure 1:
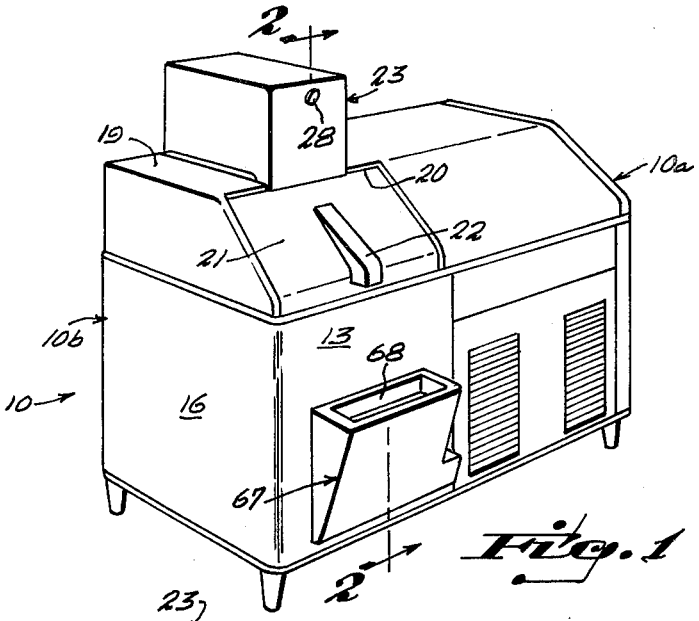
FIG. 1 illustrates, in perspective, a combination ice making machine and automatic ice dispenser embodying the invention.
Figure 2:
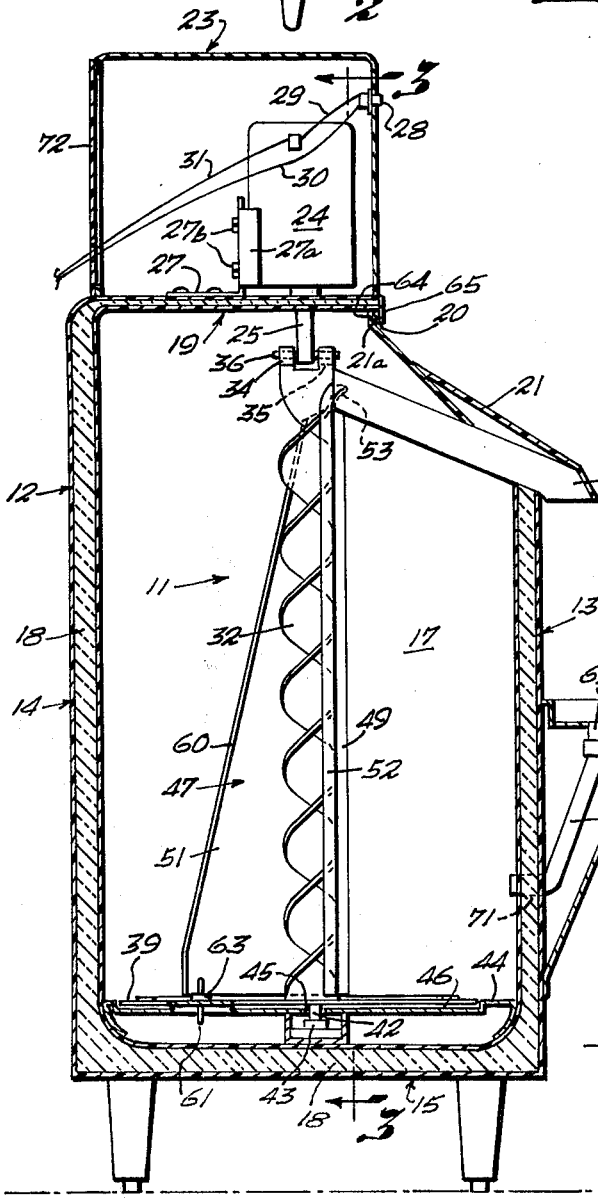
FIG. 2 is a vertical cross-sectional view taken along the plane indicated at 2—2 of FIG. 1 in the direction of the arrows and illustrating details of the auger ice elevating mechanism and its associated ice cabinet.
Figure 3:
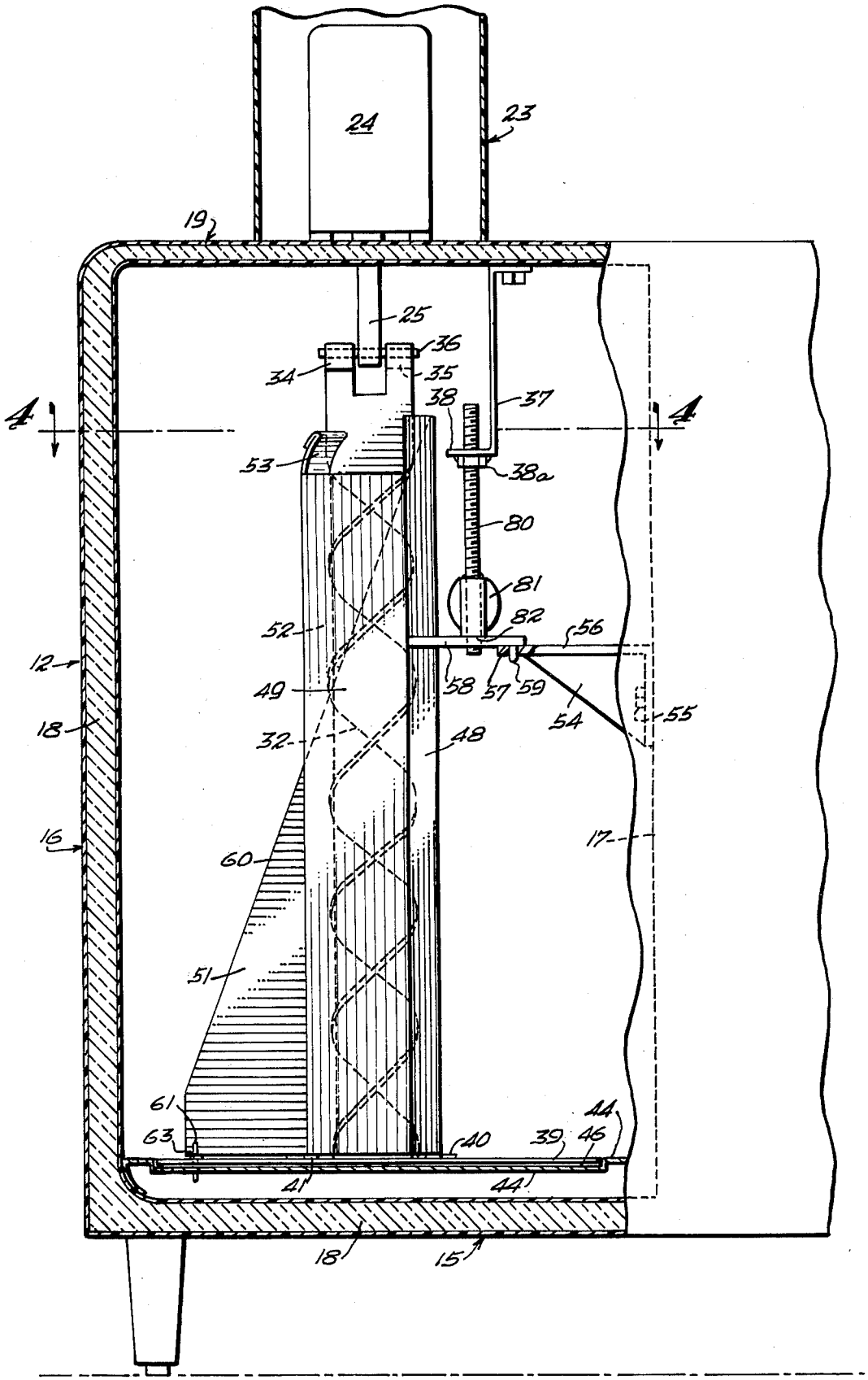
FIG. 3 is a partial vertical cross-sectional view taken along the vertical plane indicated at 3—3 of FIG. 2 in the direction of the arrows and further illustrating details of the auger ice elevating mechanism.

Referring now in detail to the drawings, reference numeral 10 in FIG. 1 designates, generally and by way of example, a combination ice making machine and automatic ice dispenser, the ice making machine portion being designated by reference numeral **10*a* and the ice dispenser portion being designated by reference numeral 10*b*. As best illustrated in FIGS. 2 and 3, the auger ice elevating mechanism embodying the invention is designated generally by reference numeral 11 and comprises the operational mechanism of the automatic ice dispenser portion 10*b* of the combination ice making machine and automatic ice dispenser 10. The auger ice elevating mechanism 11, although illustrated and described herein as comprising part of a combination ice making machine and automatic ice dispenser 10** of the type commonly used in self-serving cafeterias for the self-service dispensing of crushed or cube ice, could as well be applied to use with other types of automatic ice dispensers having a crushed or cube ice receiving bin or hopper from which ice is to be elevated for dispensing through a chute or the like extending from the upper end of the elevating mechanism.

As best illustrated in FIGS. 1, 2 and 3 the automatic ice dispenser **10*b* which houses the auger ice elevating mechanism 11 embodying the invention comprises a substantailly rectangular ice receiving cabinet 12 comprising a front wall 13, a rear wall 14, a bottom wall 15, an outer side wall 16, and an inner side wall 17 defining a partition wall between the ice making machine 10*a* and the automatic ice dispenser 10*b*. It is to be understood that the ice making machine 10*a* serves to automatically replenish the ice receiving cabinet 12 with ice cubes, and thereby provide the continuous source of the cubes for dispensing. Since the ice making machine 10*a*** forms no part of the present invention other than to automatically supply ice for dispensing, it is not further described herein.

The walls 13 through 17 comprising the ice receiving cabinet 12 each comprise spaced-apart inner and outer panels sandwiched between which are comparatively thick layers of insulation 18 which serve to attenuate heat transfer into the interior of ice cabinet 12, thereby minimizing melting of the ice while in said cabinet prior to dispensing. As best illustrated in FIGS. 1 and 2 the upper end or top of the ice receiving cabinet 12 further comprises a forewardly-extending insulated top wall portion 19, which extends somewhat short of the front wall 13 of said cabinet. The front wall 13, moreover, extends upwardly somewhat short of the top wall 19 of the cabinet to define with the front edge of said top wall a rectangular inclined opening 20. As is hereinbelow more particularly described, a front cover member 21 incorporating an ice chute 22 is hinged along its upper edge as by hinge **21*a* to the foreward edge of top wall portion 19 for closure against the inclined opening 20**.

Adjustably secured against the upper surface of the top wall portion 19 of the ice receiving cabinet 12 is a rectangular motor enclosure box 23 housing an electric motor 24 vertically mounted so that its rotary drive shaft 25 extends through said top wall portion. As best illustrated in FIG. 2, the electric drive motor 24 is vertically mounted with respect to the housing top wall portion 19 as by a bracket 27 and clamp 27*a* secured by bolts 27*b*. A push button switch 28 mounted in the front of the motor box 23 is connected in series with the energizing circuit for the drive motor 24 as indicated by electrical conductors 29, 30 and 31, conductors 30 and 31 of which extend into an electrical cable (not illustrated) for plug-in connection to an electrical source of supply.

Figure 6:
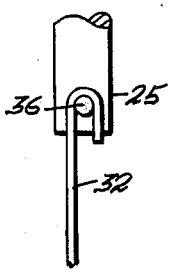
FIG. 6 is a fragmentary elevational view illustrating details of the releasable attachment mechanism of the auger and its associated ice feeder disc.

The auger ice lifting mechanism 11 comprises a removable auger 32, which is preferably formed by twisting an elongated plate of stainless steel. The upper end of the auger 32 is provided with a central, axially-extending cut-out or recess 33 defining a pair of opposed extensions each of which is reversely bent in mutually opposite directions to provide hook portions 34, 35. As best illustrated in FIGS. 2, 3 and 6, the motor drive shaft 25, near its outer or lower end, is fitted with a diametrically-extending cross-pin 36 of such length as to extend slightly beyond outer side portions of the auger hook member 34, 35 upon said auger being hooked in place for driving interconnection between the motor shaft and the auger. It will thus be apparent that releasable driving interconnection can readily be established between the rotary drive shaft 25 and the removable auger 32 simply by lifting the hook portions 34, 35 of the auger over the motor drive shaft cross pin 36.

Figure 4:
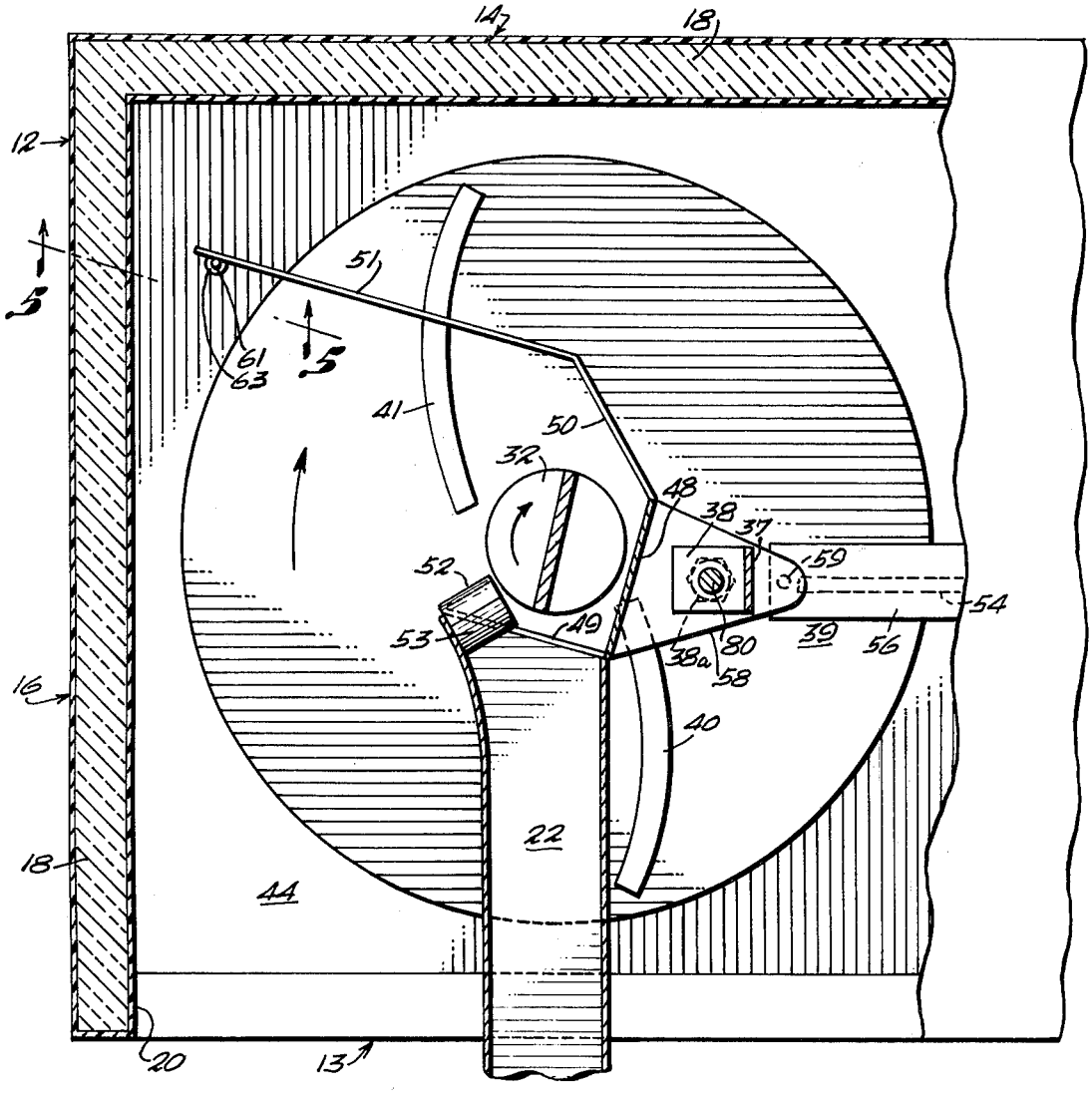
FIG. 4 is a horizontal cross-sectional view taken along the plane indicated at 4—4 of FIG. 3 in the direction of the arrows.

The lower end of the auger 32 has concentrically welded or otherwise secured thereto a circular auger disc 39 which, as best illustrated in FIG. 4, has affixed upon its upper surface a pair of diametrically-opposed, arcuate ribs 40, 41. The ribs 40 and 41 may be of stamped sheet metal welded or otherwise affixed in place, and serve, upon rotation of said auger disc, to transport cube or crushed ice deposited within the ice receiving cabinet 12 into the ice elevating mechanism 11, as is hereinbelow more particularly described. Extending coaxially from the underside of the auger disc 39 is a journal pin 42 removably receivable in a thrust bearing 43 affixed against the inside of the bottom wall 15 comprising an ice receiving cabinet 12. As best illustrated in FIGS. 2 and 3, the ice receiving cabinet 12 is fitted with a removable false bottom plate 44 having an opening 45 through which the journal pin 42 of the auger 32 passes upon assembly to its thrust bearing 43. The false bottom plate 44 is further formed with a shallow circular recess 46, concentric with the journal pin opening 45 and of such diameter and depth as to freely receive for rotation therein the auger disc 39.

As best illustrated in FIGS. 2, 3 and 4, the ice elevating mechanism comprises a relatively fixed ice elevating abutment slide member 47, cooperative with the auger 32 in elevating ice for discharge through the ice chute 22. The ice elevating abutment slide member 47 can readily be fabricated of bent sheet metal, is substantially coextensive with the auger 32, and is disposed in partially enclosing relation with respect thereto. It comprises relatively rectangularly bent side wall portions 48, 49, of substantially equal width, and an angularly bent side wall portion 50 defining an angle of approximately 45° with respect to the side wall portion 48 and being directed opposite and outwardly of the side wall portion 49. The outer vertically-extending edge of the side wall portion 50 of the ice elevating abutment slide member 47 merges into an outwardly-bent side wall portion 51 which extends substantially parallel with respect to side wall portion 49. The outer vertical edge of the side wall portion 49 of the ice elevating abutment slide member 47 extends into a comparatively narrow, reversely-bent side wall portion 52 defining an enclosed angle of approximately 45° with respect to the inside of side wall portion 49. At its upper end, the side wall portion 52 is formed with an inwardly-curved portion 53 extending arcuately over the top of the upper end of the side wall portion 49. In this connection it is to be noted that the upper end of the side wall portion 49 of the ice elevating abutment slide member 47 extends somewhat short of the upper end of side wall portion 48 to provide an opening for the passage of elevated ice cubes or crushed ice into the discharge chute mechanism, as is hereinbelow more particularly described.

Means is provided for removably securing the upper end of the ice elevating abutment slide member 47 with respect to the ice receiving cabinet 12. To this end a bracket 54 is fixed against the inner side wall 17 by bolts 55, said bracket having a horizontal, inwardly-extending top surface portion 56 near the outer end of which is a vertically-extending locating hole 57. Welded or otherwise secured to and extending outwardly of the side wall portion 48 of the ice elevating abutment slide member 47 is a wing plate 58, near the outer end of which is a downwardly-extending index pin 59 which, as illustrated in FIG. 3, fits within the through opening 57 of the bracket 54 after the ice elevating slide member 47 has been assembled in place within the ice chamber of the ice receiving cabinet 12.

Means is provided for removably securing the wing plate 58 in its proper located position as illustrated in FIG. 3. To this end, a bracket 37, fixed to and extending downwardly of the top wall 19 of the ice cabinet 12, terminates in a horizontally-extending bracket portion 38 against the underside of which is welded or otherwise secured an internally-threaded nut 38*a*. Threadingly-received within the nut 38a is a vertically-extending, externally-threaded adjustment rod 80. Threaded on the lower end of the threaded rod 80 is a wing nut 81 having a flat outer end portion 82. As is best illustrated in FIG. 3, the wing plate 58 is provided with a through opening 83 for the free passage of a lower end portion of the threaded rod 80. It will be understood that the above-described securing mechanism serves to releasably clamp the ice-elevating abutment slide member 47 in place once it has been properly positioned with its downwardly-extending index pin 59 fitted within the through opening 57 of the bracket 54.

Figure 5:
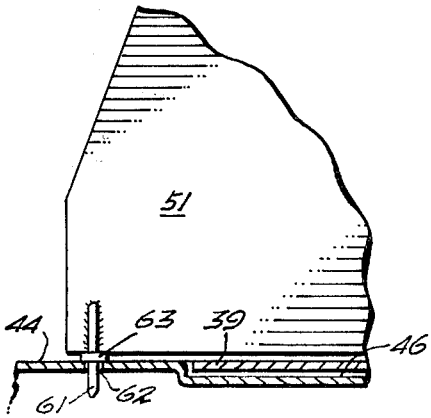
FIG. 5 is a fragmentary cross-sectional view taken along the line 5—5 of FIG. 4 in the direction of the arrows.

The upper ends of the side wall portion 50 and 51 of the ice elevating abutment slide member 47 are cut away or beveled at an angle extending from their juncture at the upper end of side wall portion 48 to a point just short of the lower end of the side wall portion 51, as indicated at inclined edge 60 in FIGS. 2 and 3. As best illustrated in FIGS. 4 and 5, the outer lower end portion of side wall portion 51 of the ice elevating abutment slide member 47, when said abutment member is fitted in place, extends beyond the outer periphery of the auger disc 39, whereat it is removably secured by means of a locating pin 61 affixed to and extending downwardly and outwardly of the lower edge of said side wall portion 51 to be receivable in a small opening 62 provided in the false bottom plate 44. As best illustrated in FIG. 5, a spacer washer 63 secured upon the locating pin 61 in abutting relation against the lower edge of the side wall portion 51 prevents abutting contact of any portion of the ice elevating abutment slide member 47 with the relatively rotating auger disc 39.

The front cover member 21 can be fabricated of fiberglass reinforced sheet plastic material, for example, and as illustrated in FIG. 2, is formed with a short, angularly-upstanding marginal lip portion 64 which hinges, as by hinge 21*a*, behind a short, downwardly-pojecting flange portion 65 provided along the front edge of the top wall portion 19 of the ice receiving cabinet 12. As illustrated in FIGS. 2 and 4, the ice chute 22 projecting outwardly and downwardly of the front of the cover member 21, at a central position therealong, extends in an upwardly inclined direction through said cover member to terminate just short of the front wall portion 49 of the ice elevating abutment slide member 47 when said front cover member is swung into closed position with respect to the ice receiving cabinet 12. The inner end of the chute 22 thus communicates with the opening at the top of the ice elevating slide member 47 defined by the foreshortened upper end of the side wall portion 49 so that the inwardly curved portion 53 of the side wall portion 52 turns into the inner end of said chute. As illustrated in FIG. 4, the left-hand side wall of the chute 22 is outwardly curved to abuttingly enclose the outer edge portion of inwardly curved portion 53.

Fixed against the outside of the front wall 13 of the ice receiving cabinet 12 is a support sink member 67, which may be integrally molded of fiberglass reinforced sheet plastic material, for example, and which comprises a sink recess 68 centrally disposed beneath the open front end of the chute 22. The sink recess 68 serves not only to support pitchers or other containers used for receiving dispensed ice, but also to receive overflow ice or water drippings for drainage through drainage pipe 69 and conduit 70 into the interior of the ice receiving cabinet 12 through an opening 71 in the front wall 13 thereof (see FIG. 2).

In operation, energization of the electric drive motor 24 upon depression of the electric push button 28 at the front of the motor box or housing 23 turns the auger 32 and its associated auger disc 39 in the clockwise direction, as seen in FIG. 4. The arcuate ribs 40 and 41 carry the contained crushed or cube ice into the side opening or mouth of the ice elevating abutment slide member 47 defined by the opposed, parallel side wall portions 49, 51 thereof, whereupon the ice will be continually pushed into the bight defined by the side wall 50 and the opposite rotating wall portions of the auger 32. The clockwise turning of the auger 32, as seen in FIG. 4, gradually lifts the crushed or cube ice along the upper inclined surface of said auger while at the same time urging the ice being lifted in sliding engagement against the inner surfaces of the side wall portions 48 and 49 until such time as the ice is elevated above the upper edge of the side wall portion 49 whereat it passes outwardly of the side opening or recess defined thereby. Thence the ice is directed by the inwardly-curved portion 53 at the upper end of the side wall portion 52 into the adjacent inner end of the ice chute 22, whence it falls by force of gravity for dispensing through the outer front end of said chute. As illustrated in FIGS. 2, 3 and 4, and as described above, the inwardly-curved portion 53 of the reversely-bent side wall portion 52 serve to slidingly guide elevated ice being clockwisely urged by the turning of the auger 32 into the open inner end of the dispensing chute 22, thereby minimizing ice overflow back into the interior of the ice receiving cabinet 12.

As described above, the ice elevating abutment slide member 47 can readily be removed for cleaning by unscrewing the wing-nut 81 from abutting engagement against the wing plate 58 and thereafter screwing the adjustment rod 80 upward in its nut 38*a* to provide for upward withdrawal of said abutment slide member through the rectangular opening 20 of the cabinet 12. The auger 32 can then be removed, as described above, simply by lifting the hook portions 34, 35 over the motor drive cross pin 36, whereupon said auger will be released for withdrawal at its low end from the thrust bearing 43 for removal through the front opening 20 of the cabinet. The ice elevating abutment slide member 47 and the auger disc assembly 32 having been removed, access is readily had to the false bottom plate 44 for its removal. It will thus be apparent that the entire ice elevating mechanism can readily be removed for cleaning, repair or replacement, and that the inside of the cabinet, having smooth wall surfaces, can easily be kept in sanitary condition.

In order to facilitate service or replacement of the drive motor 24, the rear of the motor box 23 preferably is fitted with a removable cover plate 72.

While there is illustrated and described herein only one form of auger lift mechanism for automatic ice dispensers embodying the invention, it is to be understood that this embodiment is given by way of example only and not in a limiting sense. The invention, in brief, comprises all the embodiments and modifications coming within the scope and spirit of the following claims.

We claim:

1. An ice dispenser comprising, in combination, an ice receiving cabinet, rotative auger means for lifting ice from the interior of said ice receiving cabinet for dispensing at a position near the upper end of said ice receiving cabinet, said auger means comprising an elongated auger and an ice elevating abutment slide member partially surrounding said auger, to define a side opening co-extensive with said auger, an auger disc concentrically affixed to the lower end of said auger for rotation in unison therewith, an electric drive motor, means releasably interconnecting said electric drive motor with said auger for rotating said auger and said auger disc in unison within said ice receiving cabinet, and means on the upper surface of said auger disc for urging ice in said ice receiving cabinet in the direction of said side opening of said ice elevating abutment slide member, the upper end of said ice elevating abutment slide member having a discharge opening for the dispensing of ice, said ice elevating abutment slide member being substantially co-extensive with said auger and being formed with a pair of relatively right-angularly-bent side wall portions of substantially equal width, an angularly-bent side wall portion defining an angle of approximately 45° with one of said side wall portions and being directed opposite and outwardly of the other of said side wall portions, the vertically-extending outer edge of said angularly-bent side wall portion merging into an outwardly-bent side wall portion extending substantially parallel with respect to said other of said side wall portions.

2. An ice dispenser as defined in claim 1, wherein the outer vertical edge of said other of said side wall portions extends into a comparatively narrow, inwardly-reversely-bent side wall portion defining an enclosed angle of approximately 45° with respect to the inside of said other of said side wall portions.

3. An ice dispenser as defined in claim 2, wherein said reversely-bent side wall portion is formed, at its upper end, with an inwardly-curved guide wall portion extending arcuately over the top of the upper end of said other side wall portion, the upper end of said other of said side wall portions extending somewhat short of the upper end of said one side wall portion to define said discharge opening.

4. An ice dispenser as defined in claim 3, wherein said releasable means interconnecting said auger comprises a diametrically-extending cross pin extending outwardly of each side of the drive shaft of said electric drive motor, the upper end of said auger having a central, axially-extending recess defining a pair of opposed extensions, said extensions being reversely-bent in mutually opposite directions to provide opposed hook portions, said hook portions being downwardly receivable, one each, in interhooking engagement with said outwardly-projecting end portions of said motor drive shaft cross pin.

5. An ice dispenser as defined in claim 1, including means releasably securing said ice elevating abutment slide member in substantially fixed position within and with respect to said ice receiving cabinet.

6. An ice dispenser as defined in claim 5, wherein said releasable securing means of said elevating abutment slide member comprises a locating pin affixed to and extending downwardly and outwardly of a lower edge portion of said outwardly-bent side wall portion of said ice elevating abutment slide member and being receivable in locating opening in the bottom of said ice receiving cabinet, and releasable clamp means for fixedly supporting said elevating abutment slide member in such located position.

* * * * *